United States Patent [19]

Gregory et al.

[11] Patent Number: 4,764,263

[45] Date of Patent: Aug. 16, 1988

[54] ELECTROCHEMICAL SYNTHESIS OF SUBSTITUTED AROMATIC AMINES IN BASIC MEDIA

[75] Inventors: Thomas D. Gregory; Kenneth J. Stutts, both of Midland, Mich.

[73] Assignee: The Dow Chemical Company, Midland, Mich.

[21] Appl. No.: 50,666

[22] Filed: May 18, 1987

[51] Int. Cl.[4] ..... C25G 3/00

[52] U.S. Cl. ..... 204/74

[58] Field of Search ..... 207/74

[56] References Cited

U.S. PATENT DOCUMENTS

| | | | |
|---|---|---|---|
| 3,424,659 | 1/1969 | Staal | 204/74 |
| 3,475,299 | 10/1969 | Slager | 204/74 |
| 3,475,300 | 10/1969 | Staal | 204/74 |
| 3,998,708 | 12/1976 | Kabasakalian et al. | 204/74 |
| 4,584,070 | 4/1986 | De Lue et al. | 204/74 |

OTHER PUBLICATIONS

Brown & Warner, *J. Phys. Chem.,* 27, 455–465 (1923).

Belot et al., *Tetrahedron Letters,* 25, (47), 5347–5350 (1984).

*Organic Electrochemistry,* M. M. Baizer & H. Lund, 2nd Ed., Marcel Dekker, Inc., 295–313 (1983).

*Primary Examiner*—Andrews R. L.

[57] ABSTRACT

Substituted amino aromatic compounds such as 3-amino-4-hydroxybenzoic acid are prepared by electrolytically reducing the corresponding nitro aromatic compound in a basic medium at temperatures below 60° C. and current densities greater than 50 milliamps per square centimeter. The aminohydroxybenzoic acids are useful in the preparation of polybenzoxazoles which are used to make fibers and composites having high strength and thermal stability.

17 Claims, No Drawings

ELECTROCHEMICAL SYNTHESIS OF SUBSTITUTED AROMATIC AMINES IN BASIC MEDIA

BACKGROUND OF THE INVENTION

This invention relates to the preparation of substituted aromatic amines. More specifically, it pertains to a process for the electrolytic reduction of substituted nitro aromatic compounds to produce their corresponding amines.

Of the substituted aromatic amines, aminohydroxybenzoic acids are known to be useful as monomers in the preparation of polybenzoxazoles. Polybenzoxazoles can be prepared by the condensation of certain multifunctional aromatic compounds such as the aminohydroxybenzoic acids of the present invention. Polybenzoxazole fibers have high tensile and compressive strengths and thermal stability and are desirable for military, aerospace and other applications requiring rigid materials.

The reduction of nitro aromatic compounds to their corresponding amines is well-known. For example, U.S. Pat. No. 3,475,299 describes an electrolytic reduction of a nitro aromatic compound in an acidic medium in the presence of hydrogen sulfide. U.S. Pat. No. 3,424,659 discloses a process for electrolytically reducing nitro aromatic compounds in an electrolytic cell with an acidic catholyte and a basic anolyte. U.S. Pat. No. 3,475,300 describes a process for reducing nitro aromatic compounds in the presence of sulfuric acid.

All of the above processes relate to an electrolytic reduction in acidic medium. The acidic environment of the aforementioned processes may induce a Bamberger type rearrangement of reaction intermediates, especially at elevated temperatures. The acidic medium makes aromatic compounds susceptible to nucleophilic attack by moieties present in the solution such as water. Therefore, the presence of an acidic medium may lead to the formation of undesirable by-products if direct reduction of the nitro aromatic compound to its corresponding amine is desired. Thus, the selectivity of the electrolytic reduction is decreased.

The limited electrolytic reduction of nitro aromatic compounds in the presence of base has been previously described. For example, Brown and Warner, *J.Phys.-Chem.*, 27, 455–465 (1923) describe the reduction of o-nitrophenol by electrolysis to o-amidophenol. Probably o-aminophenol was intended in an alkaline medium in the presence of various metals such as zinc, lead and copper as the cathodic material. Belot et al., *Tetrahedron Letters*, Vol. 25, No. 47, 5347–5350 (1984) disclose the electro catalytic hydrogenation of nitro compounds to amines in an alkaline medium in the presence of Devarda copper and Raney nickel electrodes. Belot et al. teach that the reduction is very inefficient and produces unwanted azobenzene when a conventional copper electrode is employed. *Organic Electrochemistry*, M. M. Baizer & H. Lund, 2nd Ed., Marcel Dekker, Inc., 295–313 (1983) teaches that the electrolytic reduction of various nitro aromatic compounds in an alkaline medium most often yields dimers and other coupled products.

An electrolytic process is needed that would provide for the selective reduction of functionalized nitro aromatic compounds in basic media to their corresponding amines. A process is also needed that would provide a high current efficiency and thereby minimize the amount of power consumed by the reaction.

SUMMARY OF THE INVENTION

The present invention is such a process for the preparation of a substituted aromatic amine comprising electrolytically reducing a substituted nitro aromatic compound in an alkaline medium at a temperature less than 60° C. and a current density of at least 50 milliamps/square centimeter to yield at least 50 percent of the desired amine.

Contrary to teaching of the prior art, the process of the present invention when carried out in an alkaline medium and in the presence of a copper cathode is very selective for the reduction of several substituted nitro aromatic compounds to their corresponding amines. Surprisingly, this process enables the high conversion of nitro to amino with very little, if any, dimer products such as azo compounds or hydroxylated products. Further advantages of the process of this invention include (1) non-corrosive basic medium, (2) lower cell voltage and lower overall voltage requirements, (3) easier separation or isolation and recovery of products, (4) less electrode fouling and (5) lower temperature operation. In addition, this process enables the use of high current densities with minimal evolution of hydrogen. As a result of these advantages, this process is a very efficient and economical method for the selective conversion of nitro aromatic compounds to aromatic amines.

DETAILED DESCRIPTION OF THE INVENTION

The substituted nitro aromatic compounds suitably converted to their corresponding amines in the practice of this invention are those nitroaromatic compounds having at least one electron-releasing ring substituent. Preferably, the nitro compound is one represented by the formula:

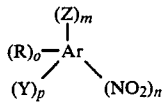

wherein Ar is an aromatic ring structure, each R is independently hydrogen, alkyl or haloalkyl, each Z is independently an electron-releasing substituent in a position ortho or para to a nitro group, Y is carboxy, sulfo, cyano, carboxylate ester, aryl, and halo, m is an integer from 1 to 5, p is 0 or 1, n is an integer from 1 to 3 and o is an integer representing the remaining positions available for substitution on the aromatic ring structure.

For the purposes of this invention, an "aromatic ring structure" is one having one or more carbocyclic and/or heterocyclic aromatic rings which may be singular or fused multiple rings or non-fused multiple rings bonded directly as in the case of biphenyl or indirectly through non-aromatic groups such as alkylidene, e.g., as in bisphenol A or a heteroatom, e.g., as in diphenyl oxide. Examples of such aromatic ring structures include benzene, naphthalene, pyridine, furan, biphenyl, diphenyl oxide, and diphenyl alkylidene such as 2,2-diphenylpropane, with benzene being the most preferred.

Exemplary electron-releasing substituents (Z) include hydroxy, alkoxy and mercapto, with hydroxy being most preferred. Of the Y substituents, carboxy and halo are more preferred with carboxy being most preferred. Examples of R include hydrogen and alkyl, particularly those having from 1 to 4 carbons, with hydrogen and methyl being preferred and hydrogen being most preferred.

Examples of preferred substituted nitro aromatic compounds include 3-nitro-4-hydroxybenzoic acid, 3-hydroxy-4-nitrobenzoic acid, 2-hydroxy-5-nitrobenzoic acid, 2-nitrophenol, 4-nitrophenol, 2-nitroanisole, 4-nitroanisole, 4-methyl-2-nitrophenol, 2-methyl-3-nitrophenol, 3-methyl-4-nitrophenol, 5-methyl-2-nitrophenol, 4-nitrophenetole and nitrotoluene. Of these nitro compounds, the nitro hydroxybenzoic acids are more preferred, with 3-nitro-4-hydroxybenzoic acid being most preferred.

In the practice of this invention, any electrolytic cell which permits the reduction of a nitro compound to an amine under alkaline conditions is suitable. The preferred electrolytic cell includes (1) a cathode of copper or similar metal which does not corrode significantly during the reduction process, (2) an anode of nickel, (3) a basic aqueous medium having a pH greater than about 7, preferably greater than 8, and a means for separating the cathode from the anode. Most preferably, the electrolytic cell has a two-chamber design.

The cathode suitably comprises a conductive material which is inert in the alkaline medium under the conditions of the process. Preferably, the conductive material is a non-corrosive metal such as copper, stainless steel or nickel, with copper being most preferred. The conductive material used for the cathode can also be a conductive carbon-containing material such as graphite, glassy carbon and reticulated vitreous carbon.

The anode can be comprised of any stable conductor which is capable of generating oxygen in basic conditions. Typical anodic materials include ruthenium on titanium, platinum, palladium and nickel, with nickel being most preferred.

In addition, it is possible and sometimes preferred to simultaneously oxidize an organic compound at the anode as in a "paired reaction". Thus, while the desired amine is being produced at the cathode, another organic compound such as nitrotoluene is being oxidized to nitrobenzoic acid at the anode.

The separation means used to define the catholyte and anolyte of the electrolytic cell can be any material which will enable the conductance of a current via ion transport through the material. Typical separators include cation- and anion-exchange membranes, diaphragms such as a porous unglazed cylinder or a sintered-glass diaphragm, glass frits, and other porous materials like clay. The separator is preferably composed of an ion exchange membrane. Most preferably, the separator is composed of a cation-exchange membrane.

The alkaline medium employed in the process of this invention is preferably a liquid medium having a pH of at least 8. The medium comprises a compound capable of acting as the electrolyte in the electrolytic cell. For the purposes of this invention, an electrolyte is a compound which dissociates in solution and provides an electrically conductive medium. Preferably, the electrolyte is a base such as alkali or alkaline earth metal hydroxides, quaternary ammonium hydroxides, ammonium hydroxide, borates, and carbonates. More preferred bases include alkali metal hydroxides with sodium hydroxide being most preferred.

The solvent for the electrolyte is suitably any liquid having a dielectric constant of at least 10 and being capable of dissolving at least 0.4 weight percent of the electrolyte. Preferably, the solvent is water, a polar organic liquid such as alcohol, lower alkyl nitriles such as acetonitrile, lower alkyl amides such as dimethylformamide, cyclic ethers such as tetrahydrofuran and mixtures of water and one or more of such polar organic liquids. More preferred solvents are water and alcohols such as methanol and ethanol and mixtures of water and such alcohols, with water being the most preferred. Thus, the more preferred alkaline media are aqueous and alcoholic solutions containing from about 0.4 to about 40 weight percent of dissolved alkali metal hydroxide or alkaline earth hydroxide. Most preferred are aqueous solutions of from about 4 to about 20 weight percent of an alkali metal hydroxide, especially sodium hydroxide. Such alkaline media preferably have pH values in the range from about 14 to about 15, most preferably about 14.

The process is suitably practiced by dispersing the substituted nitro aromatic compound in the alkaline medium in the electrolytic cell in proportions sufficient to permit the desired reduction to occur at a reasonable rate. Preferably, the nitro compound is present in the catholyte in a concentration in the range from about 0.05 to about 1, more preferably from about 0.25 to about 0.75, moles per liter of catholyte.

The current passed through the electrolytic cell is that which is sufficient to provide a desired rate of reduction of the nitro compound to its corresponding amine. Normally, such current is expressed as current density which is defined herein as the number of coulombs per second passing through a given area ($cm^2$) of the cathode surface. Preferably, the current density employed in the process of the present invention is in the range of from about 50 milliamperes/square centimeter ($mA/cm^2$) to about 300 $mA/cm^2$. The current density is more preferably in the range from about 75 to about 250 $mA/cm^2$, with an average current density from about 100 to about 150 $mA/cm^2$ being most preferred.

This process can be carried out in a continuous or batchwise manner.

The reaction temperature in the electrolytic reduction of this invention is less than about 60° C. For example, the electrolytic reduction is preferably performed at 0° C. to about 60° C., more preferably from about 17° C. to about 30° C. For the electrolysis of some compounds, higher temperatures cause undesirable side reactions and the decomposition of the nitro aromatic compound or the amine product. The electrolytic reduction of this invention is most preferably carried out at ambient temperatures.

The reaction times depend upon the quantity of the starting material, the current density, the electrode area, and the current efficiency for conversion. The end point of the reaction is generally the point when the nitro compound is consumed. For example, the end point may be found by monitoring the reaction by high performance liquid chromatography.

In a preferred embodiment, the process of this invention is carried out by electrolytic reduction of the starting nitro aromatic compound under neutral to basic condition using copper as the cathode. In this embodiment, an organic solvent may be added to the cathode chamber if the nitro compound is insoluble or only slightly soluble in water. The organic solvent used for this purpose should be an inert organic solvent which is miscible with water and dissolves the nitro compound. An example of such a solvent or cosolvent is an alcohol such as methanol, ethanol, etc. It is desirable that a blanket of nitrogen or other inert gas be employed in the electrolytic cell to prevent reoxidation of the amine product.

The process of the present invention surprisingly exhibits high current efficiencies and selectivities at high current density. Low power consumption is characteristic of the process of the present invention Therefore, the present invention provides for an economic means for producing substituted aromatic amines, particularly the aminohydroxybenzoic acids which may be used as monomers in the production of polybenzoxazoles as hereinbefore described.

SPECIFIC EMBODIMENTS

The following examples are included for the purposes of illustration only and are not to be construed to limit the scope of the invention or claims. Unless otherwise indicated, all parts and percentages are by weight.

EXAMPLE 1.

In order to investigate the effect of various parameters on the reduction of 3-amino-4-hydroxybenzoic acid, an all-glass, two-chamber, flange-type cell is constructed which allows easy disassembly and short electrolysis times. The catholyte and anolyte reservoirs are 30 ml capacity with water jacketing for temperature control. Convection is achieved via $N_2$ sparge through the bottom of each compartment. Mass transport is not ideal in this cell, but parameter evaluation can be done in an efficient manner with it. The electrodes are approximately 6 $cm^2$ and current densities are reported below for the actual geometric areas. An ion-exchange membrane (typically Nafion 324® obtained from duPont) is pressed between gaskets to expose 6 $cm^2$ area. A 14/20 ground-glass joint on top of each chamber allows for a condenser and/or an oil-filled 'bubbler' to keep a nitrogen head over the easily oxidized amine. The electrode to electrode separation is about 2.5 cm.

EXAMPLE 1a

As an initial experiment, the following standard conditions are utilized. The cathode is a flag of 99.9 percent copper (6.3 $cm^2$) and the anode a nickel expanded metal flag of equal projected area. The anolyte and catholyte are separated by a cation-exchange membrane having an exposed area of 6.3 $cm^2$. The catholyte is composed of 1 g of 3-nitro-4-hydroxybenzoic acid dissolved in 20 ml of 1N NaOH (initial pH 13–14). The anolyte consists of 20–25 ml of 5N NaOH. This reaction temperature is maintained at 25 (±1)° C. in this example.

A constant current of 0.500 amps (i.e., current density of 79.4 $mA/cm^2$) is applied through the cell after nitrogen sparging the cell for 5 minutes. Nitrogen sparge is continuously applied for mixing the catholyte and anolyte. Liquid chromatographic analyses are performed throughout the run on aliquots of the catholyte to follow the course of the reaction. The theoretical charge for conversion of the starting material to the amine is calculated as $$Q_t = (solute(g)/183\ g/mole) \times (96485\ C/eq) \times (6eq/mole).$$

The chemical yield, current efficiency (CE), and conversion are calculated with a correction for the small (but linear) increase in catholyte volume with charge passed due to water migration through the cation-exchange membrane.

At $Q_t = 100$ percent, the conversion is 83 percent, CE=85 percent, and the yield 85 percent. At $Q_t = 125$ percent, the corresponding values are conversion =93 percent, CE=71 percent and yield =89 percent.

EXAMPLE 1b

Example 1a is duplicated with the exception that the temperature is held constant at 5° C.

EXAMPLE 1c

Example 1a is duplicated with the exception that the temperature is held constant at 60° C.

EXAMPLE 1d

Example 1a is duplicated with the exception that potassium hydroxide (5N) is utilized as anolyte and 1N KOH as the solvent for the catholyte.

EXAMPLE 1e

Example 1d is duplicated with the exception that the catholyte solvent is 1M of $K_2CO_3$.

EXAMPLE 1f

Example 1a is duplicated with the exception that sodium carbonate (1M) is used as the catholyte electrolyte. The initial pH is 9.5 and the final pH is 13.7.

EXAMPLE 1g

Example 1a is repeated with the exception that sodium bicarbonate (1M) is the electrolyte in the catholyte. The initial pH is 7.9 and the final pH is 13.6.

EXAMPLE 1h

Example 1a is again repeated with the exception that potassium dihydrogen phosphate/t-butanol solution (15 percent by volume) is used as cosolvent as the catholyte. A 0.33-g portion of solute is used in this example because of solubility limitations.

EXAMPLE 1i

Example 1a is duplicated with the exception that the current density is 150 $mA/cm^2$.

EXAMPLE 1j

Example 1a is duplicated with the exception that an anion-exchange membrane (Raipore® 5035 obtained from RAI Research Corp.) is used instead of the cation-exchange membrane. Some organic transferral through the membrane is noted by discoloration of the anolyte and membrane.

The results of the preceding examples are summarized in Table I.

TABLE I

| | $Q_t^1$ = 100% | | | $Q_t^1$ = 125% | | |
|---|---|---|---|---|---|---|
| Example 1 | % Conv[2] | % CE[3] | % Yield[4] | % Conv[2] | % CE[3] | % Yield[4] |
| a | 83 | 85 | 85 | 93 | 71 | 89 |
| b | 78 | 71 | 72 | 88 | 62 | 78 |
| c | 91 | 88 | 86 | — | — | — |
| d | 89 | 85 | 85 | ·97 | 72 | 91 |
| e | 88 | 81 | 82 | 100 | 75 | 94 |
| f | 80 | 75 | 75 | 90 | 67 | 85 |
| g | 86 | 71 | 71 | 94 | 66 | 83 |
| h | 33 | 45 | 45 | 40 | 49 | 61 |
| i | 80 | 65 | 53 | 86 | 64 | 80 |

TABLE I-continued

| | $Q_t$[1] = 100% | | | $Q_t$[1] = 125% | | |
|---|---|---|---|---|---|---|
| Example 1 | % Conv[2] | % CE[3] | % Yield[4] | % Conv[2] | % CE[3] | % Yield[4] |
| j | 85 | 70 | 53 | 100 | 48 | 59 |

[1]Qt is as defined hereinbefore
[2]% Conv is percent of the nitro compound that is converted
[3]% CE is current efficiency
[4]% yield is mole percent of amine compound formed based on the nitro compound charged As evidenced by the data of Table I, the process of this invention can be practiced using different current densities, different diaphragms/membranes, different electrolytes and different temperatures. The best results, however, are obtained in this type of cell using current densities of 50 to 100 mA/cm$^2$, ambient temperatures and a cation-exchange membrane.

EXAMPLE 2

The cathode material is varied to determine the effects of this parameter. All conditions are held constant as in Example 1a above except for the variance of cathode material. Except where noted, the cathode is of the same shape and dimension as the control experiment. The purity of metals is >99 percent except as noted. The area for calculation of current density is taken to be the area of one side of the flag.

Run No. 2a: Copper

This experiment is the same as recorded in Example 1a above.

Run No. 2c: Nickel

Expanded nickel is used as the cathode in this example.

Run No. 2f: Stainless Steel

The cathode is a fine mesh of stainless steel (316 Alloy).

Run No. 2i: Graphite

The cathode is a cylinder of graphite. The area is estimated as the circumference times the length of the immersed portion of the rod.

The results of these examples are recorded in Table II.

As evidenced by the data of Table II, the process of invention is effectively practiced using all of the listed materials as the cathode. However, lead and tin do exhibit a greater degree of corrosion than does copper.

EXAMPLE 3

Cell Design:

The electrochemical cell used in this example is a parallel-plate, two-chamber design and is machined out of polypropylene. A copper cathode and a nickel anode (both 30 inches×5 inches) are separated by a cation-exchange membrane which is physically supported by titanium screens on each side. Flow distribution is accomplished via ⅛-inch holes on ¼-inch centers on top and bottom of each chamber.

Electrolysis:

The general procedure for electrolysis is to fill the anolyte reservoir with 5 liters of 5N NaOH which is supplemented with additional base when necessary in order to prevent pitting of the anode. The catholyte is then placed in the 12-liter reservoir and circulated via a centrifugal-type pump through the cell. In the reservoir is a reaction mixture containing 104 g/liter of 3-nitro-4-hydroxybenzoic acid, 40 g/liter of sodium chloride and 80 g/liter of sodium hydroxide. A nitrogen sparge is kept over the catholyte at all times during the electrolysis. A small trickle current (approx. 25 mA) is kept flowing through the cell before and between runs to protect the copper from corrosion. After circulation of the anolyte and catholyte are started (typically 600 and 1500 ml/min, respectively), the main rectifier is connected and 100 amps is passed through the cell. Aliquots of the catholyte are taken at intervals and analyzed via liquid chromatography. The current is adjusted stepwise to minimize the amount of hydrogen evolution at the cathode. The average current density is about 80 mA/cm$^2$ and the temperature is ambient temperature.

Product isolation is via acidification of the catholyte. This is accomplished via aspiration of aliquots of the catholyte into side-arm flasks which contain con-HCl and typically 10 g/liter of $SnCl_2$ (as antioxidant). Table III indicates some of the results obtained with this cell.

TABLE II

| | | | $Q_t$[1] = 100% | | | $Q_t$[1] = 125% | | |
|---|---|---|---|---|---|---|---|---|
| Run No. | Cathode | CD[5], mA/cm$^2$ | % Conv[2] | % CE[3] | % Yield[4] | % Conv[2] | % CE[3] | 5 Yield[4] |
| 2a | Copper | 79 | 83 | 85 | 85 | 93 | 71 | 89 |
| 2b | Platinum | 81 | 82 | 82 | 82 | 94 | 75 | 94 |
| 2c | Nickel | 84 | 90 | 84 | 85 | 97 | 77 | 96 |
| 2d | Lead | 69 | 94 | 88 | 88 | 100 | 77 | 97 |
| 2e | Tin | 83 | 93 | 90 | 90 | 98 | 76 | 96 |
| 2f | Stainless Steel | 76 | 93 | 94 | 95 | 100 | 83 | 103 |
| 2g | Cobalt | 78 | 80 | 83 | 83 | 93 | 77 | 97 |
| 2h | Silver | 78 | 85 | 81 | 82 | 95 | 76 | 95 |
| 2i | Graphite | 106 | 79 | 78 | 78 | 89 | 70 | 88 |

[1]Qt is as defined in Table I
[2]% Conv is as defined in Table I
[3]% CE is as defined in Table I
[4]% yield is as defined in Table I
[5]CD is current density in milliamps/square centimeter

TABLE III

| Sample No. | Catholyte vol (liters) | mole nitro[1] | Avg I (A)[2] | Liquid Chromatographic Results % Conv[3] | % Yield[4] | % CE[5] | % Isol Yield[6] | % LC Purity[7] |
|---|---|---|---|---|---|---|---|---|
| 1 | 7.32 | 3.969 | 73.0 | 96.9 | 96.5 | 91.0 | 90.4 | 99.90 |
| 2 | 8.00 | 4.312 | 71.2 | 98.8 | 98.6 | 89.8 | 88.5 | 99.97 |
| 3 | 9.00 | 4.914 | 72.3 | >95 | >98 | — | 87.9 | 100.00 |
| 4 | 6.00 | 3.226 | 75.0 | 98.9 | 94.5 | 85.8 | 89.6 | 99.95 |

TABLE III-continued

| Sample No. | Catholyte vol (liters) | mole nitro[1] | Avg I (A)[2] | Liquid Chromatographic Results % Conv[3] | % Yield[4] | % CE[5] | % Isol Yield[6] | % LC Purity[7] |
|---|---|---|---|---|---|---|---|---|
| 5 | 6.13 | 3.327 | 73.6 | 98.4 | 93.4 | 84.8 | 90.2 | 99.89 |

[1]mole nitro represents the moles of 3-nitro-4-hydroxybenzoic acid charged
[2]Avg I (A) represents the average current (AMPS) during the batch electrolysis
[3]% Conv is as defined in Table I
[4]% Yield is as defined in Table I
[5]% CE is as defined in Table I
[6]% Isol Yield is the isolated yield of the desired product
[7]% LC Purity is the purity of isolated amine hydrochloride as measured by liquid chromatography As evidenced by the data in Table III, high purity products are produced by the practice of this invention using a simple cell design and work-up procedure.

EXAMPLE 4

Cell Design:

In this example, the electrochemical cell is one of commercial design with a monopolar arrangement of 8 copper and 7 nickel electrodes to provide an active area of 5558 $cm^2$ (5.98 $ft^2$) for the cathode and anode, respectively. A cation-exchange membrane is used to separate each anode and cathode. The monopolar arrangement precludes the possibility of a low-current, high-voltage system but allows the use of both sides of an electrode. The overall dimensions of the cell are only 55×24×17 cm.

Catholyte and anolyte reservoirs are 15-gallon polypropylene tanks which are fitted with one-inch thick plexiglas tops and drilled for various fittings. The catholyte-reservoir top is fitted with a large O-ring to form an air-tight seal. Air-driven stirring is provided via stainless steel propellers, but is only used for the catholyte. Circulation through the cell is provided by 1/5 HP centrifugal pumps (3450 rpm). Magnetically coupled "paddle-wheel" type flow meters are placed in the line between the bottom of the reservoirs and the inlets of the cell. Simple shut-off valves are used on each side of the pumps in order to allow easy removal and to allow control of the flow rate. Self-priming of the pumps is accomplished by permanent elevation of the reservoirs. Stainless steel (¼-in.) tubing is coiled in each reservoir and supplied with cold water for cooling. Nitrogen purging or padding minimizes the formation of carbonate and prevents air oxidation of the amine.

The power supply for the cell consists of a rectifier capable of 18 volts (DC) and 2000 Amps (A). Five 00-welding cables provide adequate conduction to the cell to cause only slight voltage drop. A small power supply provides 0.25 A through the cell for cathodic protection whenever the main rectifier is shut off.

Syntheses:

The general procedure for the batch electrolysis is to fill the anolyte reservoir to approximately 50 liters of 5N NaOH. The catholyte consisting of 3-nitro-4-hydroxybenzoic acid (8–10 percent) in nominally 2N NaOH is pumped into a polyethylene reservoir, weighed and then transferred via slight $N_2$ pressure into the catholyte reservoir. The pumps are started and current applied quickly thereafter. Initial currents are varied from 600 to 1250 amps. Samples for liquid chromatographic analyses are taken at about every 20 percent of the theoretical charge. The anolyte is returned to original pH level after each batch electrolysis by addition of 50 percent NaOH. The current is controlled manually to minimize the amount of evolved hydrogen and to keep the cell voltage at or below 3 V. Electrolysis is generally terminated at 115 to 125 percent of the theoretical charge (determined by a conversion greater than 97 percent). A final liquid chromatographic analysis, mass and density are obtained to give the final conversion, yield and current efficiency.

Table IV shows the data and results for ten electrolyses. Isolated recrystallized yields are >80 percent with >99.9 percent purity. Cathode and anode corrosion are minimal. A high purity monomer is obtained in high yields in multi-Kg quantities with a power consumption significantly less than 2 kilowatt hour/lb.

TABLE IV

| Run No. | Electrolyses Results (Chromatographic) mole Nitro[1] | CD[3], mA/$Cm^2$ | % Conv[2] | % Yield[2] | % CE[2] | % Q[2] |
|---|---|---|---|---|---|---|
| 1 | 19.2 | 77 | 98 | 99 | 86 | 115 |
| 2 | 22.2 | 103 | 98 | 97 | 84 | 116 |
| 3 | 21.2 | 121 | 98 | 96 | 83 | 115 |
| 4 | 22.2 | 134 | 98 | 100 | 84 | 120 |
| 5 | 20.0 | 131 | 97 | 100 | 83 | 121 |
| 6 | 24.0 | 137 | 98 | 91 | 79 | 115 |
| 7 | 20.5 | 133 | 97 | 96 | 81 | 120 |
| 8 | 21.5 | 134 | 98 | 99 | 82 | 121 |
| 9 | 20.0 | 133 | 98 | 103 | 82 | 126 |
| 10 | 20.7 | 137 | 98 | 101 | 84 | 120 |

[1]Moles of 3-nitro-4-hydroxybenzoic acid
[2]Same as defined in Table I
[3]Same as defined in Table II

EXAMPLE 5

Several classes of nitro aromatic compounds are subjected to cathodic reduction in basic media at a copper electrode.

The reactions are followed by liquid chromatography with a Hewlett Packard 1090A system which incorporated a diode array as the detector. Identification of the corresponding aniline products is accomplished via retention time match and spectral authentication. Quantitation of each product is via response factor for authentic amine, either purchased with known purity, or synthesized in-house by nonelectrochemical methods.

Reaction conditions are identical to those in Example 2a unless stated differently. The major differences are changes in the solvent (usually addition of methanol) or temperature to increase the solubility of the nitro aromatic compound in the catholyte.

The reactants and products are recorded in Table V. This example demonstrates that at least six classes of nitro aromatic compounds provide good to excellent yields of amines in basic media.

TABLE V

| Run No. | Reactant[1] | Product[2] | $Q_f$[3] = 100% % Yield | % Conv | $Q_f$[3] = 125% % Yield | % Conv |
|---|---|---|---|---|---|---|
| A | NHBA(3,4) | AHBA(3,4) | 85 | 83 | 89 | 93 |
| B | NHBA(4,3) | AHBA(4,3) | 88 | 92 | 96 | 100 |

TABLE V-continued

| | | | | | | |
|---|---|---|---|---|---|---|
| C | NHBA(5,2) | AHBA(5,2) | 83 | 89 | 89 | 96 |
| D | NP(2) | AP(2) | 81 | 86 | 97 | 97 |
| E | NP(4) | AP(4) | 93 | 95 | ND[4] | — |
| F | NP(3) | AP(3) | 44 | 81 | ND[4] | 92 |
| G* | NBA(2) | ABA(2) | 24 | 72 | — | — |
| H* | NBA(4) | ABA(4) | 23 | 100 | — | — |
| I* | NBA(3) | ABA(3) | 0 | 100 | — | — |
| J | NA(2) | A(2) | 41 | 85 | 52 | 94 |
| K | NA(4) | A(4) | 63 | 88 | 70 | 93 |
| L | NA(3) | A(3) | 18 | 100 | 22 | 100 |
| M | MNP(4,2) | MAP(4,2) | 73 | 88 | 92 | 95 |
| N | MNP(3,2) | MAP(3,2) | 36 | 98 | 42 | 100 |
| O | MNP(3,4) | MAP(3,4) | 93 | 94 | 100 | 100 |
| P | MNP(5,2) | MAP(5,2) | 103** | 95 | 111** | 100 |
| Q | MNP(3,2) | MAP(3,2) | 85 | 89 | 101 | 100 |
| R | NPT(4) | PT(4) | 60 | >90 | 68 | 100 |
| S* | NB | A | 25 | 90 | 28 | 92 |
| T* | CNB(1,2) | CA(1,2) | 49 | 95 | 48 | 100 |
| U* | CNB(1,4) | CA(1,4) | 30 | 91 | 33 | 100 |
| V | NT(4) | T(4) | — | — | 55 | 100 |
| W* | NBSA(4) | ABSA(4) | 14 | 99 | 13 | 100 |

*Not an example of the invention
**Accuracy of the analytical results is poorer than normal ±5% for other runs
[1]Run A is 3-nitro-4-hydroxybenzoic acid
Run B is 3-hydroxy-4-nitrobenzoic acid
Run C is 2-hydroxy-5-nitrobenzoic acid
Run D is 2-nitrophenol
Run E is 4-nitrophenol
Run F is 3-nitrophenol
Run G is 2-nitrobenzoic acid
Run H is 4-nitrobenzoic acid
Run I is 3-nitrobenzoic acid
Run J is 2-nitroanisole
Run K is 4-nitroanisole
Run L is 3-nitroanisole
Run M is 4-methyl-2-nitrophenol
Run N is 3-methyl-2-nitrophenol
Run O is 3-methyl-4-nitrophenol
Run P is 5-methyl-2-nitrophenol
Run Q is 3-methyl-2-nitrophenol
Run R is 4-nitrophenetole
Run S is nitrobenzene
Run T is 1-chloro-2-nitrobenzene
Run U is 1-chloro-4-nitrobenzene
Run V is 4-nitrotoluene
Run W is p-nitrobenzenesulfonic acid
[2]Run A is 3-amino-4-hydroxybenzoic acid
Run B is 3-hydroxy-4-aminobenzoic acid
Run C is 5-amino salicylic acid
Run D is 2-aminophenol
Run E is 4-aminophenol
Run F is 3-aminophenol
Run G is anthranilic acid
Run H is 4-aminobenzoic acid
Run I is 3-aminobenzoic acid
Run J is o-anisidine
Run K is p-anisidine
Run L is m-anisidine
Run M is 2-amino-p-cresol
Run N is 3-amino-o-cresol
Run O is 4-amino-m-cresol
Run P is 6-amino-m-cresol
Run Q is 3-methyl-2-aminophenol
Run R is p-phenetidine
Run S is aniline
Run T is 2-chloroaniline
Run U is 4-chloroaniline
Run V is p-toluidine
Run W is p-aminobenzenesulfonic acid
[3]$Q_t$ is defined in Table I
[4]Not determined

What is claimed is:

1. A process for preparing a substituted aromatic amine comprising electrolytically reducing a substituted nitro aromatic compound in an alkaline medium at a temperature less than about 60° C. and a current density of at least about 50 milliamps/square centimeter to yield at least about 50 percent of the amine.

2. The process of claim 1 wherein the nitro aromatic compound is represented by the formula:

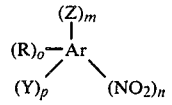

wherein Ar is an aromatic ring structure, each R is independently hydrogen, alkyl or haloalkyl, each Z is independently an electron-releasing substituent in a position ortho or para to a nitro group, Y is carboxy, sulfo, cyano, carboxylate ester, aryl, and halo, m is an integer from 1 to 5, p is 0 or 1, n is an integer from 1 to 3 and o is an integer representing the remaining positions available for substitution on the aromatic ring structure.

3. A process for preparing a substituted aromatic amine comprising electrolytically reducing a substituted nitro aromatic compound selected from the group consisting of 3-nitro-4-hydroxybenzoic acid, 3-hydroxy-4-nitrobenzoic acid, 2-hydroxy-5-nitrobenzoic acid, 2-nitrophenol, 4-nitrophenol, 2-nitroanisole, 4-nitroanisole, 4-methyl-2-nitrophenol, 2-methyl-3-nitrophenol, 3-methyl-4-nitrophenol, 5-methyl-2-nitrophenol, 4-nitrophenetole and nitrotoluene or a mixture thereof in an alkaline medium at a temperature less than about 60° C. and a current density of at least about 50 milliamps/square centimeter to yield at least about 50 percent of the amine.

4. The process of claim 3 wherein the nitro aromatic compound is a nitrohydroxybenzoic acid or a mixture of two or more nitrohydroxybenzoic acids.

5. The process of claim 4 wherein the nitrohydroxybenzoic acid is 3-nitro-4-hydroxybenzoic acid.

6. The process of claim 1 which is conducted in an electrolytic cell having a cathode of a metal which is non-corrosive under the conditions of the reduction process and an anode of a stable conductor which is capable of generating oxygen in the alkaline medium.

7. The process of claim 1 wherein the cathode is copper, stainless steel, nickel or a conductive carbon-containing material and the anode is ruthenium on titanium, platinum, palladium or nickel.

8. The process of claim 7 wherein the cathode is copper and the anode is nickel.

9. The process of claim 6 wherein the cathode and anode are separated by an ion-exchange membrane.

10. The process of claim 9 wherein the ion-exchange membrane is a cation-exchange membrane.

11. The process of claim 1 wherein the pH of the alkaline medium is at least 8 and the medium contains an electrolyte.

12. The process of claim 11 wherein the electrolyte is an alkali metal hydroxide.

13. The process of claim 1 wherein the current density is from about 50 to about 300 mA/cm$^2$.

14. The process of claim 13 wherein the current density is from about 75 to about 250 mA/cm$^2$.

15. The process of claim 14 wherein the current density is from about 100 to about 150 mA/cm$^2$.

16. The process of claim 1 wherein the temperature is in the range from about 0° C. to 60° C.

17. The process of claim 1 wherein the electrolytic reduction is carried out in an electrolytic cell having a catholyte and an anolyte both of which contain the alkaline medium and are defined by a separation means which enables the conductance of current via ion transport through the separation means.

* * * * *